US010094149B2

(12) United States Patent
Mittelbach

(10) Patent No.: US 10,094,149 B2
(45) Date of Patent: Oct. 9, 2018

(54) MOTOR VEHICLE DOOR LOCK

(71) Applicant: Kiekert Aktiengesellschaft, Heiligenhaus (DE)

(72) Inventor: Stephan Mittelbach, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 921 days.

(21) Appl. No.: 14/419,110

(22) PCT Filed: Jul. 25, 2013

(86) PCT No.: PCT/DE2013/000411
§ 371 (c)(1),
(2) Date: Feb. 2, 2015

(87) PCT Pub. No.: WO2014/019565
PCT Pub. Date: Feb. 6, 2014

(65) Prior Publication Data

US 2015/0233151 A1 Aug. 20, 2015

(30) Foreign Application Priority Data

Jul. 31, 2012 (DE) ..... 20 2012 007 325 U

(51) Int. Cl.
*E05B 85/00* (2014.01)
*E05B 79/10* (2014.01)

(52) U.S. Cl.
CPC ..... *E05B 85/00* (2013.01); *E05B 79/10* (2013.01); *Y10T 70/5155* (2015.04)

(58) Field of Classification Search
CPC ..... E05B 85/00
USPC ..... 292/216
See application file for complete search history.

(56) References Cited

U.S. PATENT DOCUMENTS 2,446,206 A * 8/1948 Beckman ..... E05B 15/0255 292/341.12
2,924,473 A * 2/1960 Krause ..... E05B 83/16 292/11
4,538,845 A * 9/1985 Yamada ..... E05B 85/02 292/216
4,735,447 A 4/1988 Kleefeldt
(Continued)

FOREIGN PATENT DOCUMENTS

DE 3526501 A1 2/1987
DE 19920278 A1 11/2000
(Continued)

OTHER PUBLICATIONS

Machine Translation of DE202007002225U by Lexis Nexis Total Patent on Jan. 28, 2015.
(Continued)

*Primary Examiner* — Carlos Lugo
(74) *Attorney, Agent, or Firm* — Woodard, Emhardt, Moriarty, McNett & Henry LLP

(57) ABSTRACT

The invention relates to a motor vehicle door lock, having at least one housing (3) and at least one lever (5) mounted rotatably about an axis (4) in the housing (3), wherein the lever (5) can be coupled to an actuating element (6) disposed outside the housing (3) and for this purpose passes through an opening in the housing (7), and the lever (5) has a cover (8) which substantially completely closes the housing opening (7) when viewed over the entire travel path(s) thereof.

13 Claims, 2 Drawing Sheets

(56) References Cited

U.S. PATENT DOCUMENTS

| | | | | | |
|---|---|---|---|---|---|
| 4,779,912 | A * | 10/1988 | Ikeda | E05B 81/25 | 292/201 |
| 5,233,879 | A * | 8/1993 | Watanuki | E05B 81/25 | 403/334 |
| 5,603,539 | A * | 2/1997 | Gruhn | E05B 85/243 | 292/199 |
| 5,762,384 | A * | 6/1998 | Bartel | E05B 77/48 | 292/201 |
| 5,855,130 | A * | 1/1999 | Rorabacher | E05B 77/34 | 292/201 |
| 5,938,253 | A * | 8/1999 | Szablewski | E05B 81/14 | 292/201 |
| 6,375,234 | B1 | 4/2002 | Brackmann et al. | | |
| 7,213,482 | B2 * | 5/2007 | Minasian | E05B 81/25 | 192/20 |
| 8,678,452 | B2 * | 3/2014 | Nagaoka | E05B 77/265 | 292/201 |
| 9,499,272 | B2 * | 11/2016 | Kearsey | B64D 11/0015 | |
| 9,708,837 | B2 * | 7/2017 | Bendel | E05B 77/34 | |
| 2002/0036408 | A1 | 3/2002 | Jang | | |

FOREIGN PATENT DOCUMENTS

| | | | |
|---|---|---|---|
| DE | 10065358 | C2 | 12/2002 |
| DE | 202007002225 | U1 | 7/2007 |
| JP | 08105260 | A | 4/1996 |

OTHER PUBLICATIONS

Machine Translation of JP08105260A by Lexis Nexis Total Patent on Jan. 28, 2015.

* cited by examiner

MOTOR VEHICLE DOOR LOCK

CROSS-REFERENCE TO RELATED APPLICATIONS

This application is the U.S. national stage application of International Patent Application No. PCT/DE2013/000411, filed Jul. 27, 2013, which claims priority of German Application No. 20 2012 007 325.7, filed Jul. 31, 2012, which are both hereby incorporated by reference.

BACKGROUND

The invention relates to a motor vehicle door lock, having at least one housing and at least one lever mounted rotatably about an axis in the housing, wherein the lever can be coupled to an actuating element disposed outside the housing and for this purpose passes through an opening in the housing.

The motor vehicle lock described above is generally not just equipped with the aforementioned lever, but furthermore comprises at least one locking mechanism equipped with a locking pawl and a rotary latch. The rotary latch interacts, for example, with a striker attached to the B-pillar in such a manner that the aforementioned motor vehicle door lock connected to a motor vehicle door and said striker in entirety form a motor vehicle door closure. Mostly, multiple levers are provided inside the housing by means of which various functional states of the motor vehicle door lock can be implemented, such as "open," "closed," "unlocked," or "locked."

These aforementioned functional states are typically defined mechanically by actuating elements such as inside door handle, outside door handle, inside lock button, lock cylinder for outside locking, etc. The usual procedure is that an associated outside operating lever, an outside locking lever, etc. inside the housing are led outwards through respective associated openings in the housing or pass through said housing openings as described. This is necessary because the respective levers are typically mechanically connected to the associated actuating elements that are mounted away from the motor vehicle door lock, for example, in a motor vehicle door, via connecting elements such as Bowden cables, rods or the like. This is how this is done in prior art representing the generic type of such lock according to DE 35 26 501 A1. This applies similarly to DE 100 65 358 C2.

For example, the outside operating lever in the housing is mechanically coupled to an outside door handle mounted away from the housing on the outside of a motor vehicle door. The outside locking lever may be mechanically connected to a lock cylinder provided in the vicinity of the outside door handle. An additionally provided inside door handle in general acts on the inside operating lever, and an inside lock button is mechanically connected to said inside locking lever in the case outlined here.

The inevitably provided housing openings pose the risk that the longevity of the motor vehicle lock and its unchanged operation are adversely affected. Dust, dirt, moisture, etc. can penetrate into the interior of the motor vehicle lock through the respective at least one housing opening. In an extreme case, this will result in corrosion, which will not only impair operability but may paralyze it completely.

According to DE 199 20 278 A1, attempts have been made in prior art to use a hermetic seal of the housing in a motor vehicle door lock. However, this results in a relatively complex and costly design. In addition, this comes at the price of reduced flexibility because mandatory connecting elements between operating elements provided on the outside and locking elements implemented on the inside have to be taken into account.

SUMMARY

It is therefore the technical problem of the invention to further develop a motor vehicle door lock of the construction described above such that its longevity and safe operation are improved and in particular the ingress of contaminations and moisture in the vicinity of the housing opening is completely prevented or at least considerably reduced.

This technical problem is solved in that a motor vehicle door lock of the generic type in question is characterized in that the lever has a cover which substantially completely closes the housing opening over the entire travel path (of said lever).

This means that this invention does not pursue the goal of any special sealing measures directly at the housing opening and instead provides the lever mounted rotatably about an axis with a mandatory special cover. At the same time, the housing opening may optionally comprise such an additional sealing. The cover is configured and arranged such that it helps to completely close the housing opening over the entire travel path of the lever. A completely hermetic seal is not possible in this area because the lever is moved back and forth relative to the housing inside the housing opening. The lever indeed performs a pivoting movement about its axis, within a swing angle that is mostly limited by one or more stops. The travel path of the lever corresponds to this movement.

According to the invention, any remaining slits that allow the pivoting movement between the cover and the housing opening are so small in dimension that there will typically be no ingress of moisture, which explains the substantially complete closure. By nature, this does not apply to air and very fine dust. But the ingress of such substances is harmless because they virtually do not impair operation.

The detailed implementation of the configuration described mostly involves that the cover is connected to the lever approximately at the center of the longitudinal extension of the lever. In this way, the cover mostly divides the lever into an inside lever portion disposed inside the housing and an outside lever portion disposed outside the housing. The outside lever portion is connected to, or can be coupled to, the actuating element provided outside the housing. This is mostly done when the motor vehicle door lock is installed in an associated motor vehicle door. In contrast, the inside lever portion of the lever in question acts on other levers, switches, the locking mechanism, etc. depending on the function and configuration of said lever.

In this context, the inside lever portion can be designed as an open circle segment part with a limit stop housed inside. The limit stop, together with the inside lever portion or the circle segment part, respectively, defines potential swing angles of the lever about its axis and consequently the associated travel path. In contrast, the outside lever portion is mostly designed as a tab part projecting from the housing. The tab part in this context is configured for coupling with the actuating element that is likewise disposed outside the housing and away from the same.

According to a particularly advantageous embodiment, the cover and the housing opening have an arched shape. This configuration considers the fact that the lever makes a pivoting movement about its axis that is arched as well to be able to adopt individual functional positions.

The further procedure is in general that both the cover and the housing opening extend radially relative to the axis of the lever. The cover and the housing opening typically comprise a largely matching radius relative to the axis. The housing opening is therefore generally an arched slit and in particular a circular arc slit. This arched slit has a predetermined and mostly constant slit width. The arched slit also has a specific arch length which reflects the maximum possible swing angle of the lever.

The cover is advantageously an arched rib and in particular a circular arc rib. This arched rib has a predetermined and mostly constant rib width. The arched rib also has a specific rib length. The rib length of the arched rib and the arch length of the arched slit are adjusted to one another. The rib length of the arched rib typically exceeds the arch length of the arched slit by a predetermined measure. This predetermined measure corresponds to at least one allowed swing angle of the lever or takes the same into account.

This means that the arched rib ensures on the one hand that the arched slit in the housing is closed, for example, in the neutral or resting position of the lever. The arched rib must in addition be equipped with one or several protrusions. The cover or the arched rib, respectively, mostly comprise about similar protrusions on both sides relative to the housing opening when the lever is in its resting position. These respective protrusions ensure that, when rotating the lever from the resting position to the one end position as well as to the other end position, the housing opening is always closed by the arched rib or cover, resorting in addition to the respective protrusion mentioned above.

It has proven beneficial if the lever and the cover are formed as an integral component. The material the lever is made of and the method of its manufacture are not critical for the invention; plastic components such as an injection-molded part, a zinc die-cast component, or a sintered metal part are conceivable. A plastic component has proven particularly beneficial for cost reasons and in order to keep the weight of the motor vehicle door lock as low as possible. It is particularly preferred if the lever is configured as an injection-molded plastic part. In general, the lever is any lever of the motor vehicle door lock that is or could be configured accordingly and is led outwards of the lock.

As a result, a motor vehicle door lock is provided that is particularly well sealed and equipped, as it were, with a hermetically closed housing. This is because the one or the other lever that is inevitably led outwards from the housing is provided with a special cover which substantially completely closes an associated and mandatory housing opening over the entire travel path of the lever that passes through the housing opening. In this way, operational reliability is considerably increased; specifically, corrosion inside the motor vehicle door lock is prevented. Longevity over large timescales can be guaranteed.

In addition, the costs associated with the implementation of the motor vehicle door lock according to the invention are virtually negligible. This is because the respective lever and cover advantageously are a plastic component, particularly an injection molded plastic part that can be manufactured cost-efficiently and easily meets various requirements. This means that the variant implemented according to the invention can virtually be applied to every motor vehicle door lock and implemented there. Herein lie the main benefits of the invention.

BRIEF DESCRIPTION OF THE DRAWINGS

The invention will be explained in greater detail below with reference to the drawing that shows just one exemplary embodiment, wherein.

DETAILED DESCRIPTION OF THE DRAWINGS

Figure 2:
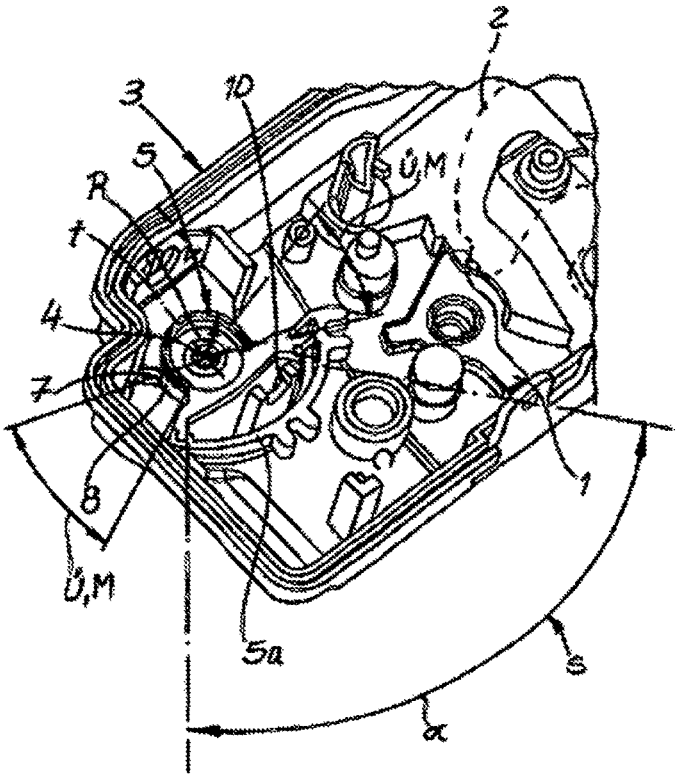
FIG. 2 shows a different view of the motor vehicle door lock according to FIG. 1 with a partially opened housing.

The figures show a motor vehicle door lock having a locking mechanism 1, 2. FIG. 2 only shows the locking pawl 1 of the locking mechanism 1, 2 whereas the associated rotary latch 2 is only hinted at. The motor vehicle door lock also comprises a housing 3 and a lever 5 that is mounted rotatably about an axis 4 in the housing 3. The lever 5 is not restrictively just an outside locking lever 5. In addition to the lever 5, other levers are disposed in the housing 3 but are not shown here for the sake of clarity.

Figure 1:
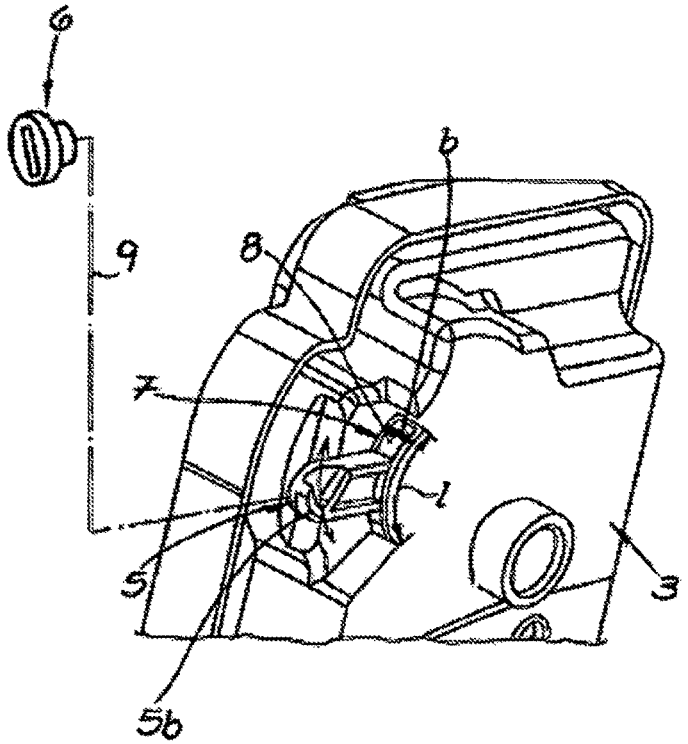
FIG. 1 shows the motor vehicle door lock according to the invention, α.

The lever 5 can be coupled with an actuating element 6 disposed outside the housing 3 and only hinted at in FIG. 1. The actuating element 6 in this embodiment is a locking cylinder by means of which the lever or outside locking lever 5 can be brought into the functional positions "unlocked" or "locked," as described in detail in the prior art documents cited above.

A housing opening 7 is provided so that the lever 5 can be coupled with the actuating element 6 disposed outside the housing 3. The lever 5 passes through the housing opening 7. According to the invention, the lever 5 comprises a cover 8 to prevent moisture or dirt from penetrating through the housing opening 7 into the housing 3. The cover 8 ensures that the housing opening 7 is substantially completely closed over the travel path of the lever 5.

When comparing FIGS. 1 and 2, it becomes apparent that the lever 5 is largely configured in two parts. The lever 5 is actually composed of an inside lever portion 5*a* disposed inside the housing 3 and outside lever portion 5*b* disposed outside the housing 3. The above-mentioned and described mechanical connection to the actuating element 6 disposed away from the motor vehicle door lock is achieved via the outside lever portion 5*b* of the lever 5. This can typically be achieved using rods, Bowden cables, etc. Anyhow, a connecting element 9 only schematically shown in FIG. 1 located between the actuating element 6 and the lever 5 or its outside lever portion 5*b* is used at this point.

The inside lever portion 5*a* is designed as an open circle segment part 5*a* and encompasses on its inside a limit stop 10. This limit stop 10 ensures together with the configuration of the inside lever portion 5*a* as a circle segment part 5*a* that the lever or outside locking lever 5, respectively, can cover a specific swing angle α indicated in FIG. 2. This includes the travel path s of the lever 5 mentioned above. In contrast, the outside lever portion 5*b* is mostly designed as a tab part 5*b* projecting from the housing 3. The connecting element 9 can be coupled to the tab part 5*b* in question on the one hand and to the actuating element 6 on the other hand to achieve the desired mechanical connection between the actuating element or locking cylinder 6 and the tab part 5*b* or the lever or outside locking lever 5, respectively.

When comparing FIGS. 1 and 2, it becomes apparent that the cover 8 is connected to the lever 5 approximately at the center of the longitudinal extension of the same. In this embodiment, the lever 5 is indeed an integral component 5, 8. In this example, the integral component 5, 8 is designed as an injection-molded plastic part 5, 8 that combines the lever 5 and the cover 8.

The cover 8 divides the lever 5 into the inside lever portion 5*a* inside the housing 3 and the outside lever portion 5*b* outside the housing as described above. The cover 8 and the housing opening 7 are each generally arched. It becomes apparent from FIG. 2 that the cover 8 and the housing opening 7 each extend radially to the axis 4. The cover 8 and the housing opening 7 typically comprise a largely matching radius R relative to said axis 4.

In this way, the housing opening 7 is designed in its entirety as an arched slit, in particular a circular arc slit 7. The housing opening 7 or circular arc slit 7, respectively, has a predetermined and constant slit width b, as becomes apparent from FIG. 1. The housing opening or circular arc slit 7 also has an associated arch length l.

The cover 8 is designed corresponding to the housing opening 7 as an arched rib and in particular as a circular arc rib 8. The circular arc rib 8 has a predetermined rib width which is mostly constant over the length of the circular arc rib 8. The rib width of the circular arc rib 8 is approximately adjusted to the slit width b of the circular arc slit 7. In contrast, the arched rib 8 has a rib length t which exceeds the arch length l of the circular arc slit 7 by a predetermined measure M.

It can indeed be seen in FIG. 2 that the lever 5, when brought into its resting position, or its cover 8 or circular arc rib 8, respectively, comprise approximately similar protrusions U on both sides relative to the housing opening 7 that is closed by means of the arched rib 8. The predetermined measure M by which the rib length t of the circular arc rib 8 exceeds the arch length l of the circular arc slit 7 is about equivalent to double the protrusion U, that is:

$$t=I+2U.$$

This ensures that the housing opening 7 or the circular arc slit 7, respectively, is closed by means of the circular arc rib 8 when viewed over the entire travel path s of the lever 5. This is ensured by the protrusions U on both sides, which reflect the swing angle $\alpha$ of the lever 5. In other words, the predetermined measure M is at least equivalent to the allowed swing angle $\alpha$ of the lever 5 in one direction.

The invention claimed is:

1. A motor vehicle door lock comprising:

a housing;

a pivotably accommodated lever that comprises an outside lever portion exposed outside the housing and configured to be connected to an actuating element arranged outside the housing, and an opposed inside lever portion that comprises a pivotal portion defining an axis of rotation and mounting the lever in the housing, the lever is configured to pass through a housing aperture, wherein the pivotal portion defines a cover that predominantly completely seals the housing aperture over its entire distance; wherein the cover and the housing aperture are arch-shaped; and wherein the cover and the housing aperture run radially compared to the axis for the lever.

2. The motor vehicle door lock according to claim 1, wherein the cover is connected to the lever roughly centrally compared to a lengthwise extension of the lever.

3. The motor vehicle door lock according to claim 1, wherein the cover subdivides the lever into an internal lever section inside the housing and an external lever section outside of the housing (3).

4. The motor vehicle door lock according to claim 3, wherein the internal lever section interacts with a limiting stop as an open circular segment section.

5. The motor vehicle door lock according to claim 4, wherein the external lever section is designed as a lug section protruding from the housing.

6. The motor vehicle door lock according to claim 1, wherein the cover and the housing aperture are equipped with a largely concurrent radius compared to the axis.

7. The motor vehicle door lock according to claim 1, wherein the housing aperture is formed as an arched slot, in particular a circular arched slot slit with a specified slot width and arch length.

8. The motor vehicle door lock according to claim 7, wherein the cover is designed as an arched bar, in particular a circular arched bar with a specified bar width and bar length.

9. The motor vehicle door lock according to claim 8, wherein the bar length of the arched bar exceeds the arch length of the arched slot by a specified amount.

10. The motor vehicle door lock according to claim 9, wherein the specified amount at least takes into account permitted pivot angle of the lever.

11. The motor vehicle door lock according to claim 1, wherein the cover is arranged with roughly the same overhang on both sides of the housing aperture in each instance in the at rest position of the lever.

12. The motor vehicle door lock according to claim 1, wherein the lever including the cover is formed as a single-part plastic component.

13. The motor vehicle door latch according to claim 1, wherein the lever including the cover is formed as a single-part plastic injection-molded component.

* * * * *